United States Patent [19]

Vonlanthen et al.

[11] 4,270,372

[45] Jun. 2, 1981

[54] KEY AND LOCK SYSTEM

[75] Inventors: Benno Vonlanthen, Messen; Robert Walther, Zollikofen, both of Switzerland

[73] Assignee: R. Berchtold AG, Zollikofen, Switzerland

[21] Appl. No.: 67,663

[22] Filed: Aug. 20, 1979

[30] Foreign Application Priority Data

Aug. 22, 1978 [CH] Switzerland ..... 81001/78

[51] Int. Cl.[3] ..... E05B 19/06

[52] U.S. Cl. ..... 70/406; 70/358; 70/409

[58] Field of Search ..... 70/358, 364 R, 406, 70/409, 411

[56] References Cited

U.S. PATENT DOCUMENTS

| | | | |
|---|---|---|---|
| 3,264,852 | 8/1966 | Gysin | 70/364 R |
| 3,412,588 | 11/1968 | Schwegler | 70/358 |

FOREIGN PATENT DOCUMENTS 1087932 2/1961 Fed. Rep. of Germany .

*Primary Examiner*—Robert L. Wolfe

*Attorney, Agent, or Firm*—Wender, Murase & White

[57] ABSTRACT

A key for a safety lock having two grooves on each flat side with pairs of identical grooves being located symmetrically opposed about the central axis of the key profile. The grooves (2,3) and the tumbler cams are fashioned in pairs with different dimensions, for the purpose of increasing the number of possible combinations. Thus, both the width and/or depth of a groove may be constant or variable.

5 Claims, 4 Drawing Figures

KEY AND LOCK SYSTEM

The present invention relates to a method or system for increasing the number of combinations in the configuration of keys and their safety locks, whereby on the flat sides of the key profile two grooves each are provided, and whereby pairs of identical grooves are symmetrically opposed either side of the longitudinal axis of the key profile such that the key is insertable in opposite rotary positions (a similar key is disclosed in U.S. Pat. No. 3,264,852). Although the number of possible combinations in the configuration of such safety locks is very high, the combination possibility soon becomes exhausted and thus above all in the manifold configuration of main keys which fit a large number of different locks.

It is an object of the present invention in safety locks and keys of the above type to provide groups of associated keys and locks which are mutually cancelling, i.e. wherein keys of a certain group cannot be used to open locks of another group. With this it is now possible for combinations exhausted for one group to be fully exploited again with another group.

This object in accordance with the present invention is attained in that groups of associated keys and locks are formed, whereby the grooves of the keys and the tumblers of the locks within a group are executed in pairs with identical dimensions but different dimensions from one group to the other. Since in the types of keys and locks in question herein the grooves of the keys and the tumblers of the locks each have to be so dimensioned that they interengage substantially without any clearance, because only in this way can the tumblers be disengaged with the insertion of the key, any lock actuation by a key of a different group wherein grooves of which are wider than the tumblers of the lock (and consequently may be inserted) is impossible.

It is in fact known to graduate the profile of keys of a locking system so that keys having an excessively large profile cannot be inserted in a lock having an excessively small key passage (German Pat. No. 1 078 932). On the other hand, keys having a small profile may be inserted and, if the combination agrees, may also be used to actuate the lock. Thus it is not a question of a complete mutual exclusion of groups of keys and also the measures directed only to locking insertion have nothing in common with the measures adopted in accordance with the invention.

The invention will be described further, by way of example, with reference to the accompanying drawings, in which.

Figure 1:
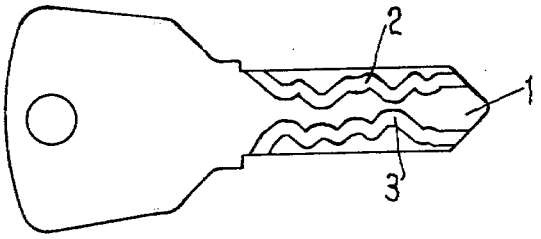
FIG. 1 is a side view of a key having grooves of varying width.
Figure 3:
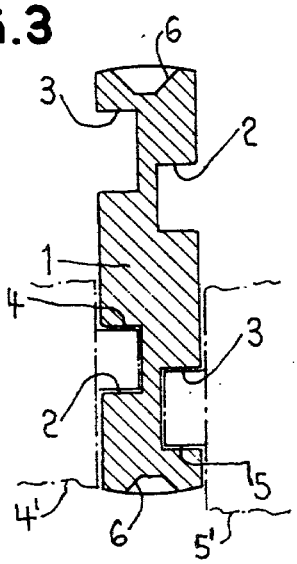
FIG. 3 is a section taken on the line III—III of FIG. 2.

A key is shown in FIG. 1 and corresponds to a known key with respect to its outer shape and its overall dimensions. On each of the two flat surfaces, key profile 1 has a narrow groove 2 and a wide groove 3—as is especially apparent from FIG. 3. Grooves of identical width and identical shape are centrally symmetrically opposed with reference to the longitudinal axis of the key profile 1. In FIG. 3, the tumbler shafts 4' and 5' include tumbler pins 4 and 5, respectively, as indicated in chain-dotted lines. These tumbler pins 4 and 5 also vary in diameter so that the tumbler pins 4 associated with the narrow grooves 2 have a smaller diameter than the tumbler pins 5 associated with the wide grooves 3. Thus it is impossible to insert a key with grooves of identical width narrower than the diameter of the tumbler pins 5 into the lock. Furthermore, while it is possible to insert into the lock a key with grooves of identical width large enough to receive the tumbler pins 5, the tumbler pins 4 would then have excessive clearance in the key grooves so that the tumblers concerned would not be brought into their prescribed positions for turning the lock cylinder. Thus it is ensured that under all circumstances, each lock can be actuated only with a key specifically associated with that particular lock.

The position of the grooves on the key may also be changed, i.e the wider grooves 3 may be located in the positions of the narrower grooves 2 and vice versa. In this manner two additional key and lock types are possible, i.e the number of available key and lock combinations may be quadrupled compared with the system having grooves and tumbler pins of identical width.

Figure 2:
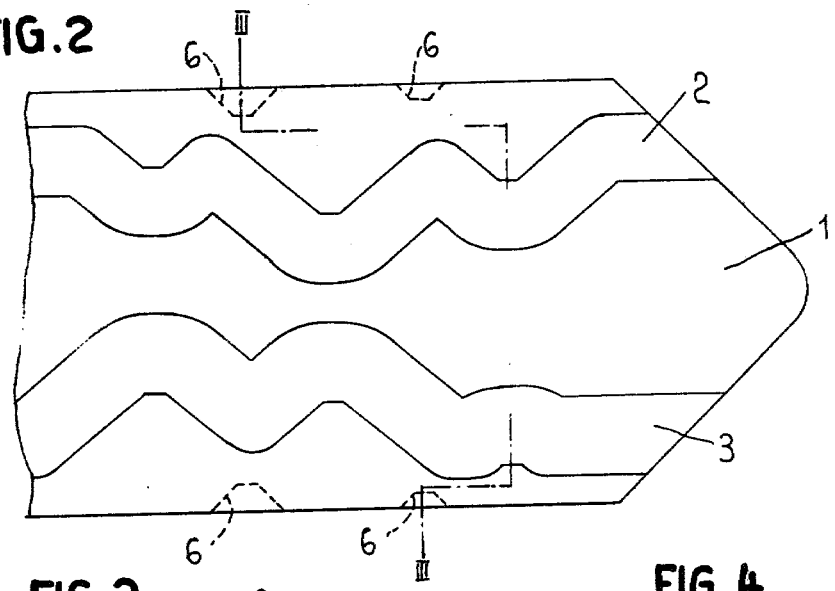
FIG. 2 is a detail on an enlarged scale of the key of FIG. 1.

As shown by FIGS. 2 and 3, the key profile also at the narrow sides is provided with frusto-conical bores 6 of different depths, whereby the number of possible combinations is additionally increased and this may be still further increased by varying the offsets.

Figure 4:
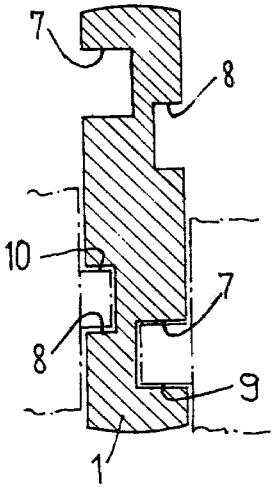
FIG. 4 is a section through an alternative embodiment along a section corresponding to that of FIG. 3.

The number of different lock and key types may be further increased in that not only the width but also the depth of the grooves is changed. In FIG. 4 the cross-section of a key profile is shown which is provided with grooves differing in depth, namely two centrally symmetrically opposed, shallower grooves 8. In FIG. 4 the tumbler pins 9 associated with the deep grooves 7 are longer than the tumbler pins 10 associated with the shallow grooves 8. Thus it is not possible to insert a conventional key having two grooves of identical depth into the lock, because the longer tumbler pins 9 block the insertion of the key. The depth of the deeper grooves 7 preferably extends to about one half, at the most slightly further, of the key thickness.

Moreover, it is possible to provide further lock and key alternatives in that the grooves and pins are different in width and depth.

Finally, it is also possible to vary the width and/or depth within a groove in pairs, whereby of course, the groove has to be wider and/or deeper at the inlet than at the rear.

The measures described to increase possible combinations of keys and associated safety locks not only have the advantage of increasing the possible combinations to a multiple, but it is clearly impossible for inaccurate key imitations to be inserted at all in the lock. This reduces the danger of locks being damaged by using inaccurate key copies or that inaccurate key copies, even though inserted, do not permit the actuation of the lock.

Moreover, when using grooves, the depth of which extends over at least half the thickness of the key, makes copying substantially more difficult, if not impossible.

The embodiments of the invention in which an exclusive property of privilege is claimed are defined as follows:

1. In a lock and key system including a lock cylinder having a plurality of tumbler shafts with associated tumbler pins of predetermined dimensions and a key having grooves with predetermined width and depth dimensions provided in each side face for engaging said pins, the improvement wherein said key comprises:

a first pair of identical grooves located in opposite side faces of said key symmetrically about the central longitudinal axis of said key for engaging a first set of tumbler pins;

a second pair of identical grooves located in opposite side faces of said key symmetrically about the central longitudinal axis of said key for engaging a second set of tumbler pins; and one of the width and depth dimensions of said first pair of grooves and the dimensions of said first set of pins are unequal to the width and depth dimensions of said second pair of grooves and the dimensions of said second set of pins, whereby the lock can only be opened by a key having grooves of similar width and depth dimensions and cannot be opened by a key having grooves of different dimensions.

2. A key as recited in claim 1, wherein both the width and depth dimensions of said first pair of grooves and the dimensions of said first set of pins are unequal to the width and depth dimensions of said second pair of grooves and the dimensions of said second set of pins.

3. A key as recited in claim 1 or 2, wherein the depth dimension of one of said first pair and said second pair of grooves is equal to at least one-half of the distance between the side faces of said key.

4. A key as recited in claim 1 or 2, wherein one of the width and depth dimensions of at least one of said first pair and said second pair of grooves varies within said one of said pair of grooves.

5. A key as recited in claim 1 or 2, wherein said key has narrow sides abutting said side faces, and said narrow sides are provided with recesses.

* * * * *

UNITED STATES PATENT AND TRADEMARK OFFICE

CERTIFICATE OF CORRECTION

PATENT NO. : 4,270,372

DATED : June 2, 1981

INVENTOR(S) : BENNO VONLANTHEN et al

It is certified that error appears in the above—identified patent and that said Letters Patent is hereby corrected as shown below:

Title page, left column under the heading "Foreign Application Priority Data", the country and serial number "Switzerland..... 81001/78" should be -- Europe.....78810014 --.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*